US006085711A

United States Patent [19]

Gerst

[11] Patent Number: 6,085,711

[45] Date of Patent: Jul. 11, 2000

[54] SOLOSTART SAFETY MOUNT

[76] Inventor: Barry E. Gerst, 103 Greatbelt Rd., Butler, Pa. 16002-9026

[21] Appl. No.: 09/134,512

[22] Filed: Aug. 14, 1998

[51] Int. Cl.[7] ..... F02N 11/00

[52] U.S. Cl. ..... 123/179.27; 123/179.25; 248/655

[58] Field of Search ..... 123/179.27, 185.7, 123/179.25; 248/655

[56] References Cited

U.S. PATENT DOCUMENTS

| | | | |
|---|---|---|---|
| 2,475,750 | 7/1949 | McCormick et al. | 123/179.27 |
| 3,190,276 | 6/1965 | Diggs | 123/179.27 |
| 3,939,369 | 2/1976 | Sullivan | 123/185.7 |
| 5,052,653 | 10/1991 | Coraccio | 123/179.27 |
| 5,535,713 | 7/1996 | Braddock | 123/179.27 |

*Primary Examiner*—Andrew M. Dolinar
*Attorney, Agent, or Firm*—John B. Dickman, III

[57] ABSTRACT

A model airplane starter motor mount for supporting the motor having a slidable glider platform movable on a stationary base to start a model airplane when the propeller spinner is pressed against the rubber clutch bushing on the motor. Roller bearings are positioned between the glider platform and the stationary base for sliding the glider platform. There is an acutuator attached to the stationary base at one end and to the glider platform to flex the actuator on the glider platform, and actuate a switch on the starter motor to start the starter motor.

23 Claims, 2 Drawing Sheets

SOLOSTART SAFETY MOUNT

FIELD OF THE INVENTION

This invention relates to an automatic starter mechanism for model airplanes, and more particularly, to such a mechanism's mounting base with a device to contact and actuate a switch for activating the starter mechanism.

BACKGROUND OF THE INVENTION

Model airplanes, particularly radio controlled airplanes, are often started by a hand held motor with a driver rubber bushing on the end of a motor shaft. Holding the airplane in one hand, the rubber bushing is pressed against the spinner using the other hand, thereby turning over the engine to start it.

The problem with this type of starter is that the person's face, hands and forearms are close to the propeller, which is made of wood, plastic or nylon. Should a part of the engine, propeller or starter break, the operator could suffer any number of injuries. When the engine starts further dangers arise such as reaching past the propeller to adjust the throttle valve or disconnect a battery pack from a glow plug, if used. As stated in the prior art, airplane propellers spin at speeds of 8,000 to 25,000 RPM. The engines power is from a fraction of a horsepower to 3 Hp and higher. Therefore, the starting of the engine can be a high-risk injury situation.

A starter as shown in the following patents is presently being used. This starter is mounted on a box as in U.S. Pat. Nos. 2,475,750, 5,052,653 and 5,535,713. In each of these patents, the operator holds the airplane with two hands, from behind the engine. The propeller spinner is pushed into a rubber bushing on the starter motor shaft. Contract with the starter activates a starter switch to start the airplane engine.

SUMMARY OF THE INVENTION

This invention relates to a starter motor mount for a model airplane starter where the operator is behind the airplane engine and propeller for safety purposes.

The airplane engine starter is basically 12 volt electric motor with a switch which is normally open. When the switch is closed a motor output with a rubber clutch bushing is rotated at high speed. The rubber clutch bushing is designed to engage the spinner on the propeller, such that the friction between the rubber clutch bushing and the spinner spins the propeller which turns the engine over to start it.

The starter motor mount of the invention provides a base that is secured to a fixed object. Slidably mounted on the base is a platform glider for limited reciprocating movement. A pair of posts that extend vertically from the platform glider support the engine starter. A spring device is anchored to the base at one end and inserted into a groove in the platform glider. The spring device is positioned to engage the switch of the starter motor when the propeller spinner is pressed into the rubber clutch bushing. Pressure of the spinner reciprocates the platform glider causing the spring device to flex, closing the switch starting the starter motor, consequently starting the airplane motor.

It is an object of the invention to provide an automatic switching mechanism for a model plane starter motor using the starter motor mount of the invention.

Another object of the invention is to provide a starter motor mount which is safer, simple to use, and easy to manufacture.

It is a further object of the invention to provide a starter motor mount which enables the operator to engage the propeller spinner and rubber clutch bushing wholly behind the airplane.

Other objects, features and advantages will occur to those skilled in the art from the following description of the invention and the accompanying drawings.

DESCRIPTION OF THE INVENTION

Figure 3:
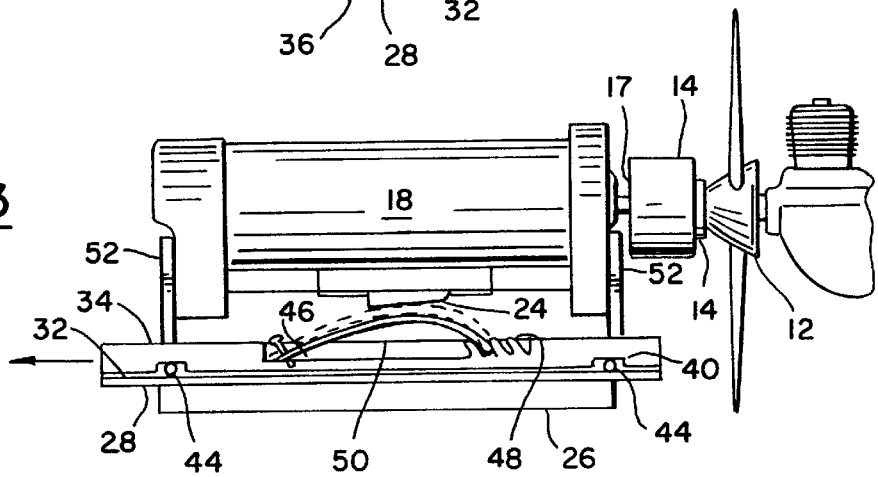
FIG. 3 is a side view with a partial cross section showing the invention and airplane starter motor.
Figure 4:
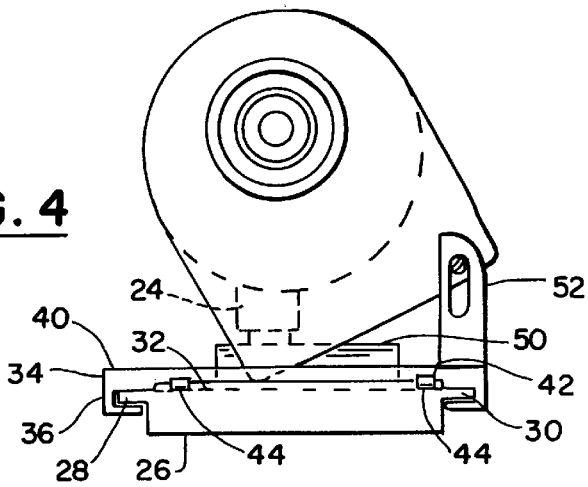
FIG. 4 is a front view with a partial cross section showing the invention and airplane starter motor.

Referring to the drawings, FIGS. 1 to 4, there is shown an airplane starter mount 10. According to the invention, that could be mounted on a stationary object. Eventhough it is not shown, both hands of the operator are gripping the airplane behind the airplane engine and propeller, where it is easy to disconnect the battery wire to the glow plug and to adjust the fuel needle valve. The propeller spinner 12, FIG. 4, is engaged with the rubber clutch bushing 14 fixed to a metal cup 16 on rotating shaft 17 of a starter motor 18. Starter motor 18 receives its power from a battery inside a field box, not shown, connected to a switch 24 and to starter motor 18, respectively, which are not shown. The starter motor is mounted on the airplane starter mount 10 such that switch 24 is positioned to be opened or closed by movement of the airplane starter mount 10.

Looking at FIGS. 1 to 4, the airplane motor mount 10 has a stationary mounting base 26 with glider supports 28 and 30. Each glider support is a continuation of the stationary mounting base's top surface 32 and extends beyond the stationary mounting base 26 in such a manner that a platform glider 34 will slide on the glider supports. The platform glider 34 is rectangular in shape with a pair of U-shaped channels 36 and 38 which slide over glider supports 28 and 30. FIG. 4 shows at least a pair of slots 40 and 42 which house roller bearings 44 to make the movement of the platform glider 34 close to being friction free.

There is a rectangular cut-out 46 positioned under the starter motor 18 and its switch 24. Just in front of cut-out 46, are a plurality of upstanding slots 48. A flex strip actuator 50 is anchored to the stationary mounting base 26 top surface 32 within the cut-out 46, as in FIGS. 1 and 3. The end of the flex strip actuator 50 that is not anchored is placed in one of the upstanding slots 48 by flexing the actuator 50. The flex strip actuator 50 can be placed in any one of upstanding slots 48, depending on the amount of tension desired. The switch 24 is in contact with the flex strip actuator 50 where movement in the direction of arrow A will cause the flex strip actuator 50 to close the switch 24 actuating starter motor 18.

Figure 1:
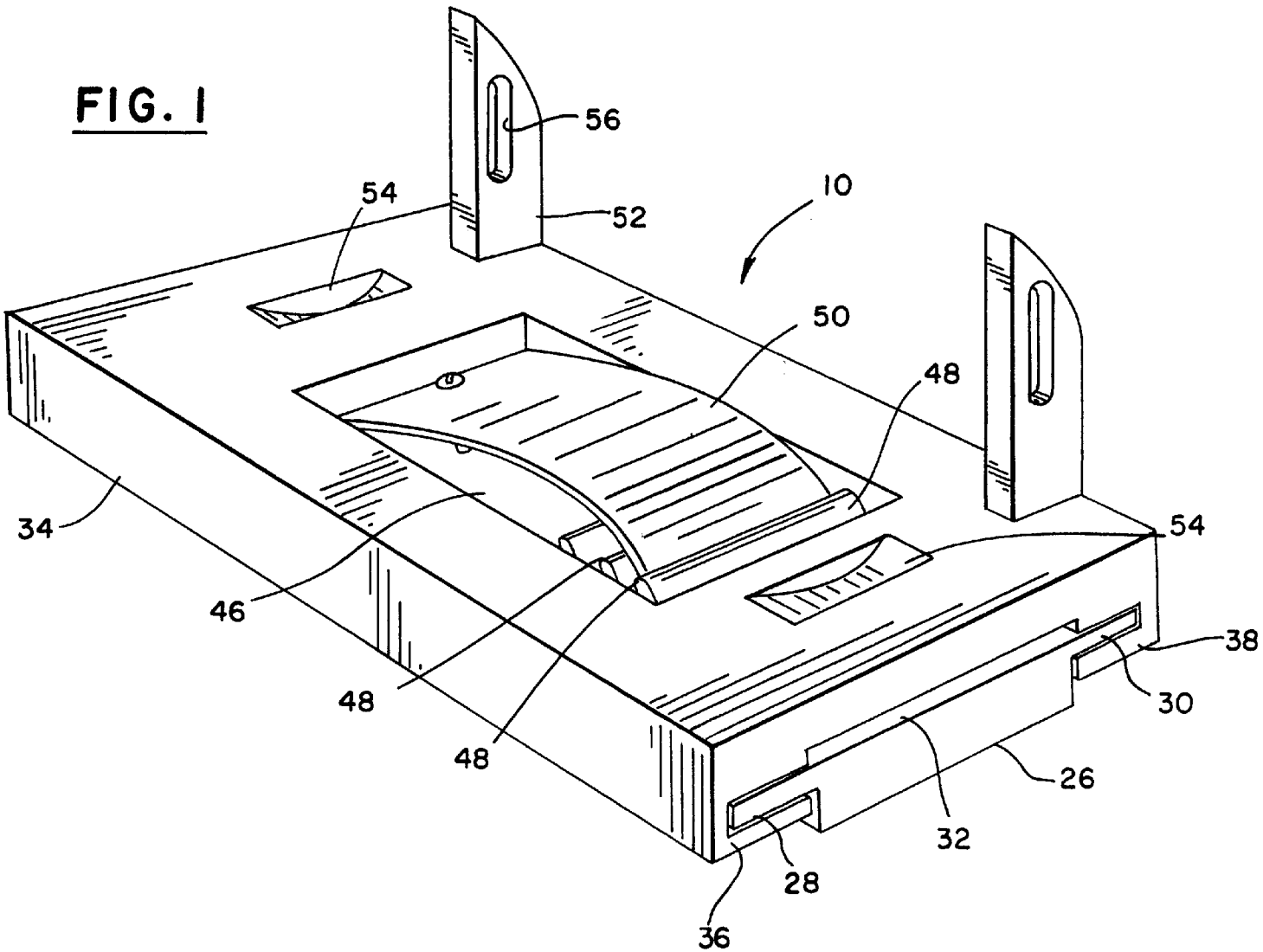
FIG. 1 is an isometric view of the invention.
Figure 2:
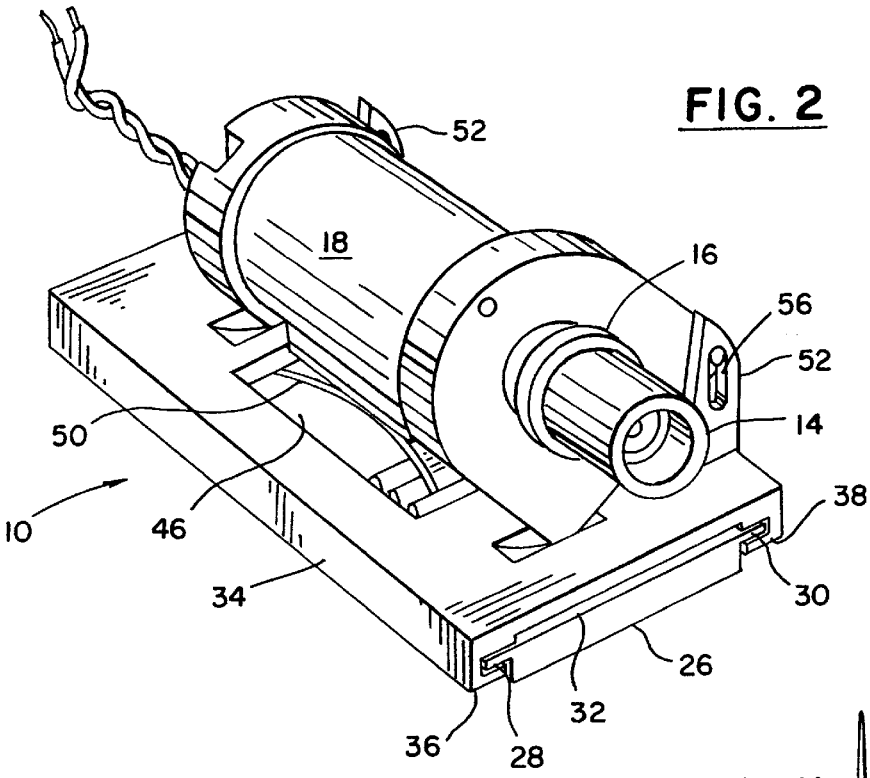
FIG. 2 is a perspective view of the invention with a model airplane starter motor in place.

FIG. 1 shows a pair of vertical supports 52 and a pair of arcuate slots 54 support starter motor 18. The vertical supports 52 have elongated slots 56 to adjust the position of the starter motor 18 in order to more easily align the switch 24 with the flex strip actuator 50. FIG. 3 shows, in broken line, starter motor 18, switch 24 and flex strip actuator 50.

In use, the starter motor 18 is positioned on the starter motor mount 10 and a model airplane P is placed in front of the starter motor with propeller spinner S pressed into rubber clutch bushing 14. Pressure on the rubber clutch bushing 14 causes platform glider 34 to move against the tension of the flex strip actuator 50. Flexing flex strip actuator 50 closes switch 24, turning on starter motor 18, which in turn spins spinner S to start airplane engine E.

Although particular preferred embodiments of the invention have been disclosed in detail for illustrative purposes, it will be recognized that variations or modifications of the disclosed apparatus, including the rearrangement of parts, will lie within the scope of the present invention.

Adjustability of supports 52 and extension of arcuate slots 54 to facilitate the mounting of various electric starter motors is contemplated and within the purview of the invention.

The embodiments of the invention in which an exclusive property or privilege is claimed are defined as follows:

1. A model airplane starter motor mount to assist in starting model airplanes comprising:

A stationary mount;

A glider platform slidably mounted on said stationary mount where said stationary mount having an opening to expose the top surface of said stationary mount;

A flex-strip actuator means anchored to said stationary mount to extend through said opening and connect to said glider platform, whereby as said glider platform slides said flex-strip actuator means flex to actuate a starter motor mounted on said starter motor mount.

2. A model airplane motor mount as in claim 1, wherein said stationary mount having glider support means on which said glider platform slides.

3. A model airplane motor mount as in claim 2, wherein said glider support means are continuations of the top surface of said stationary mount.

4. A model airplane starter motor as in claim 3, wherein said glider platform having U-shaped channel means to engage said glider support means to guide said glider platform.

5. A model airplane starter motor mount as in claim 1, wherein said glider platform having roller bearing support means and roller bearings to slide said glider platform on said stationary mount.

6. A model airplane starter motor mount as in claim 2, wherein said glider platform having roller bearing support means and roller bearings to slide said glider platform on said stationary mount.

7. A model airplane starter motor mount as in claim 3, wherein said glider platform having roller bearing support means and roller bearings to slide said glider platform on said stationary mount.

8. A model airplane starter motor mount as in claim 4, wherein said glider platform having roller bearing support means and roller bearings to slide said glider platform on said stationary mount.

9. A model airplane starter motor mount as in claim 2 wherein said flex strip actuator means is connected to said glider platform in an upstanding slot in said glider platform.

10. A model airplane starter motor mount as in claim 3 wherein said flex strip actuator means is connected to said glider platform in an upstanding slot in said glider platform.

11. A model airplane starter motor mount as in claim 4 wherein said flex strip actuator means is connected to said glider platform in an upstanding slot in said glider platform.

12. A model airplane starter motor mount as in claim 5 wherein said flex strip actuator means is connected to said glider platform in an upstanding slot in said glider platform.

13. A model airplane starter motor mount as in claim 6 wherein said flex strip actuator means is connected to said glider platform in an upstanding slot in said glider platform.

14. A model airplane starter motor mount as in claim 7 wherein said flex strip actuator means is connected to said glider platform in an upstanding slot in said glider platform.

15. A model airplane starter motor mount as in claim 8 wherein said flex strip actuator means is connected to said glider platform in an upstanding slot in said glider platform.

16. A model airplane starter motor mount as in claim 1 wherein said glider platform has starter motor support means.

17. A model airplane starter motor mount as in claim 16, wherein said starter motor support means having vertically disposed slot means to adjust said starter motor.

18. A model airplane starter motor mount as in claim 10 wherein said glider platform has starter motor support means.

19. A model airplane starter motor mount as in claim 11 wherein said glider platform has starter motor support means.

20. A model airplane starter motor mount as in claim 12 wherein said glider platform has starter motor support means.

21. A model airplane starter motor mount as in claim 13 wherein said glider platform has starter motor support means.

22. A model airplane starter motor mount as in claim 14 wherein said glider platform has starter motor support means.

23. A model airplane starter motor mount as in claim 15 wherein said glider platform has starter motor support means.

* * * * *